US006425339B1

(12) United States Patent
Furlong et al.

(10) Patent No.: US 6,425,339 B1
(45) Date of Patent: Jul. 30, 2002

(54) CHAIN TENSIONER AND STOPPER

(76) Inventors: Donn B. Furlong, 7710 73rd Pl. NE., Marysville, WA (US) 98270; Richard R. Trelstad, P.O. Box 801, LaConner, WA (US) 98257; Jeffrey C. Newell, 27615 15th Ave NE., Arlington, WA (US) 98223

( * ) Notice: Subject to any disclaimer, the term of this patent is extended or adjusted under 35 U.S.C. 154(b) by 0 days.

(21) Appl. No.: 09/891,565

(22) Filed: Jun. 25, 2001

(51) Int. Cl.[7] ..... B63B 21/18

(52) U.S. Cl. ..... 114/200

(58) Field of Search ..... 24/116 R; 114/199, 114/200

(56) References Cited

U.S. PATENT DOCUMENTS

| | | | | |
|---|---|---|---|---|
| 41,235 A | | 1/1864 | Perkins | |
| 311,573 A | * | 2/1885 | Emery | 114/200 |
| 3,638,599 A | | 2/1972 | Nilsen | |
| 4,130,067 A | | 12/1978 | Kilgus et al. | |
| 4,221,364 A | * | 9/1980 | Nishimura | 254/338 |
| 4,425,862 A | * | 1/1984 | Hirsch et al. | 114/199 |
| 4,936,239 A | | 6/1990 | Awalt, Jr. | |
| 5,097,787 A | | 3/1992 | Bruce | |
| 5,934,216 A | | 8/1999 | Childers et al. | |

* cited by examiner

*Primary Examiner*—Ed Swinehart
(74) *Attorney, Agent, or Firm*—Jensen & Puntigam, PS

(57) ABSTRACT

A device that is adjustable along the length of a chain, which can serve both as a stopper and, because it includes an overcenter latch, as a tensioner to assure that the chain is taut.

4 Claims, 6 Drawing Sheets

CHAIN TENSIONER AND STOPPER

TECHNICAL FIELD

This invention relates to a device for securing an anchor chain in a taut condition, and more particularly, to a unitary assembly that includes an over-center locking device or other means for use with a chain or the like to assure that the chain is maintained in a taut condition when stowed. The device in addition to the overcenter adjustment is adjustable along the path of travel of the chain to accommodate chain variations.

BACKGROUND OF THE INVENTION

Means of securing anchor lines or chains known to the inventor include:

U.S. Pat. No. 41,235, granted to Perkins on Jan. 12, 1864, discloses a pivotally mounted pawl mounted to the deck of a boat and secured in place by a securing cable, wherein the pawl is movable from a downward locking position, wherein the pawl extends through a link of the chain to an upward release position. The patent also discloses a means for holding the pawl in the locked position.

U.S. Pat. No. 3,638,599, granted to Nilsen on Feb. 1, 1972, discloses a chain stopper positioned on an adjustable base, including a locking pin, which prevents the pawl from being raised out of engagement with the anchor chain, negating accidental release.

U.S. Pat. No. 4,130,067, granted to Kilgus et al on Dec. 19, 1978, discloses a means for securing a chain and a vehicle tie-down for use with railway cars, wherein the length of the chain may be adjusted to assure a secure tie-down.

U.S. Pat. No. 4,936,239, granted to Awalt Jr. on Jun. 26, 1990, discloses a toggle/tensioner lock, which includes a lock, which is adjustable relative to the base for securing a chain, and a lock, which is easily movable over the hook to prevent accidental dislodgement.

U.S. Pat. No. 5,097,787, granted to Bruce on Mar. 24, 1992, discloses a device for tensioning opposed anchor chains.

U.S. Pat. No. 5,934,216, granted to Childers et al on Aug. 10, 1999, discloses a hydraulic tensioning device, wherein the links are passed from one pawl to another, automatically controlled by the hydraulic control system.

SUMMARY OF THE INVENTION

When utilizing a chain, it is often necessary and desirable to have a separate mechanism for stopping the chain and retaining it in its stopped position without transferring the stresses created during use back to the windlass or the like.

Further when a chain is being transported and is not in active use, it is desirable to have a slight tension on the chain to prevent unnecessary movement and rattling.

With the above-noted prior art and desires in mind, it is advantageous to have a single mechanism which can serve to stop or anchor a chain at a particular position, and further, be adjustable such that the chain can always be quickly and easily secured in a taut condition to avoid unnecessary rattles and movement.

The present invention accomplishes the desired results by having an upper portion, including a pawl secured to an overcenter cam, for engaging a chain link which is adjustably secured to a lower or support section secured to a relatively fixed object. Included as a part of the mechanism herewith is a means interconnecting the upper portion with the lower portion of the device which allows relative adjustment to accommodate chain variations, such that when the device is secured in its locked position, the chain will be held in a taut condition when stowed and isolated from a winch or the like when in use.

BEST MODE FOR CARRYING OUT THE INVENTION

Figure 1:
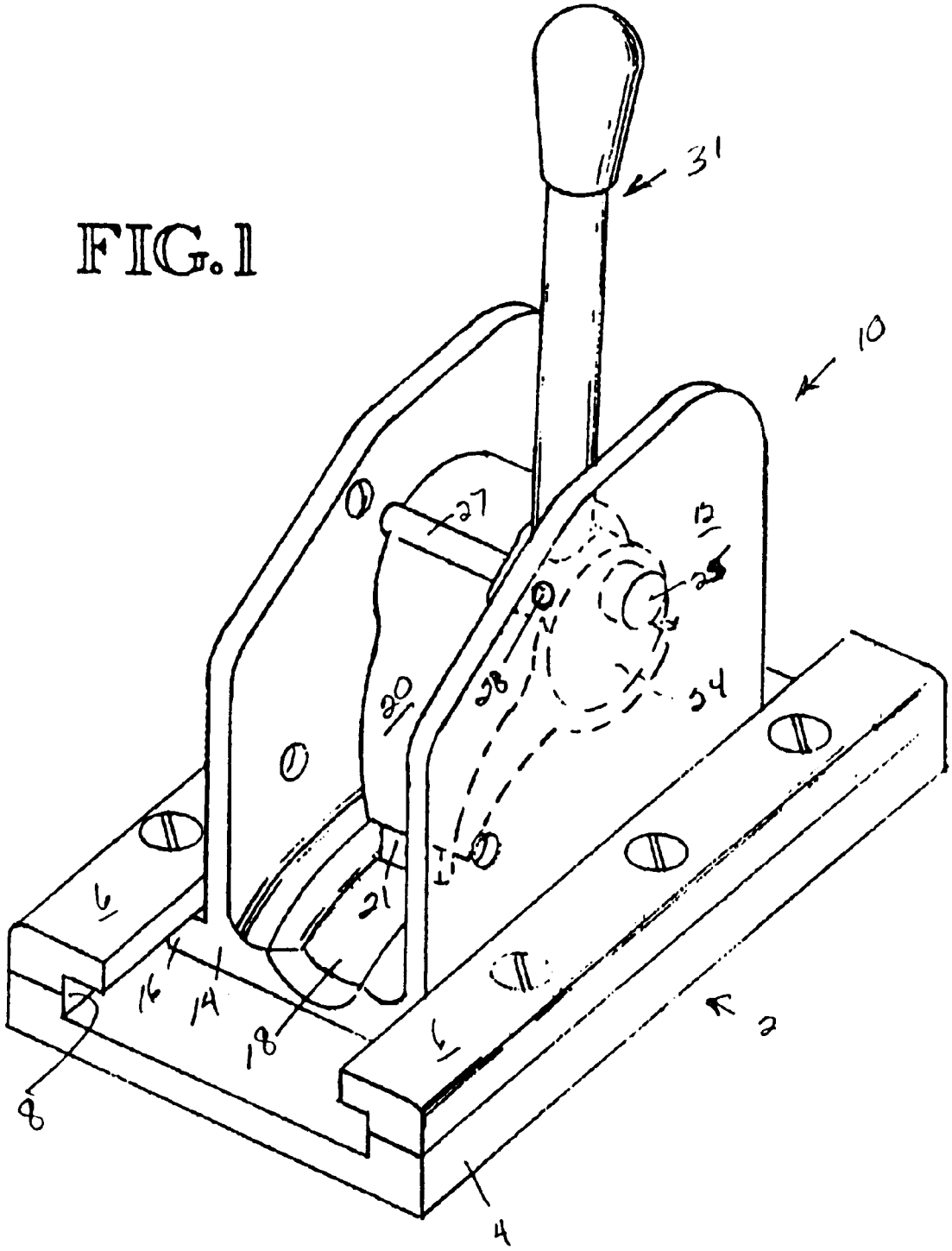
FIG. 1 is an isometric view of the preferred embodiment of the inventive snubber stopper.

As seen in FIG. 1, the chain snubber/stopper includes a base element 2, which includes a bottom portion 4, which is secured to the deck or the like and upper rail members 6, rigidly secured to the bottom member 4 and forming opposing channels 8 to capture the upper assembly 10, including a pair of side plates 12 joined b y a bottom member 14, including outwardly extending flanges 16 to interact with grooves 8 and a chain-guiding channel 18. Mounted between the parallel plates 12 is a pawl 20, rotatable around a cylinder 24 such that the pawl is movable from a locked position as shown to an unlocked position wherein the chain is free to pass through the apparatus. Also to be noted in this view are opposing openings in side plates 12 numbered 26 and 28 to receive a release through pin to hold the pawl in either the locked or unlocked position.

Figure 1A:
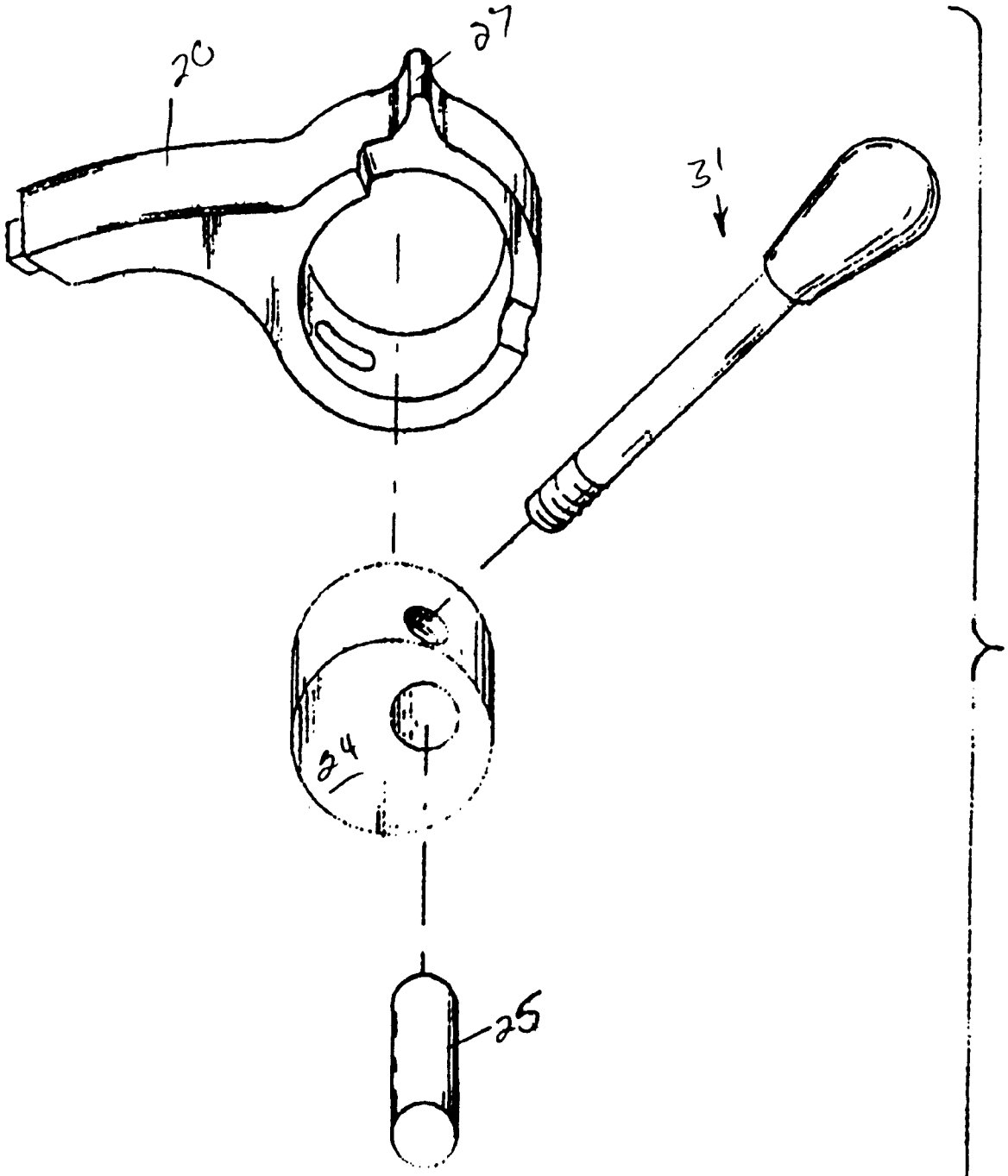
FIG. 1A is an exploded view of the pawl mechanism of FIG. 1.

As best seen in FIG. 1A, the pawl 20 is rotatably mounted upon cylinder 24 which is eccentrically mounted by pin 25. The pawl is moved to and from locked position using ridge 27 and then moved forwardly, to the left in FIG. 1A, by turning cylinder 24 by handle 31, placing tension on the chain stretching between the chain snubber/stopper and the stowed anchor.

Figure 2:
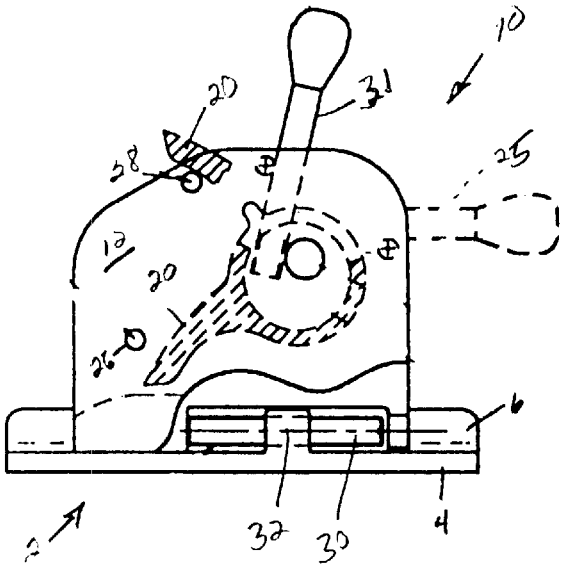
FIG. 2 is a side elevation view of the snubber stopper shown in FIG. 1.
Figure 3:
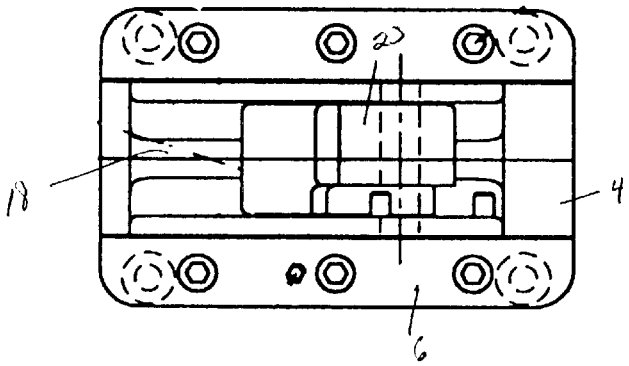
FIG. 3 is a plan view of the snubber stopper shown in FIG. 1.
Figure 4:
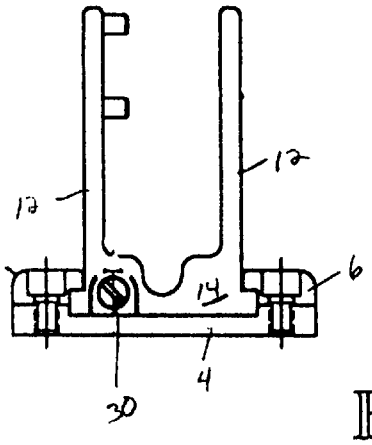
FIG. 4 is an end elevation of the snubber stopper of FIG. 1 with parts removed for clarity.

Reference is now had to FIG. 2 wherein identical numbers are used to identify the same parts as in FIG. 1. The lower portion of side plate 12 is broken away, such that the threaded member 30 which is threadingly engaged with an ear 32 integral with the base member 4 is shown such that the upper assembly 10 may be linearly adjusted in its relationship with respect to the base 2, such that when the anchor is stowed and the pawl easily engage with the chain, the chain can be kept in a taut position to prevent rattling on the deck during movement. It is to be understood that the pawl 20 may also be used as a chain stop when the anchor is deployed, the pawl engaged and the release pin (not shown) is in place.

Figure 5:
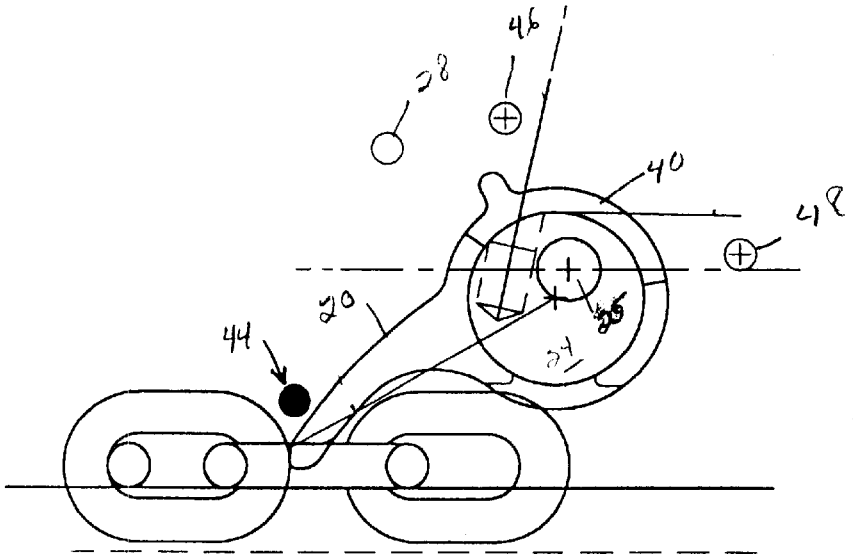
FIG. 5 is a partial sectional view of the pawl of FIG. 1 showing the interaction with a chain in the locked position.
Figure 6:
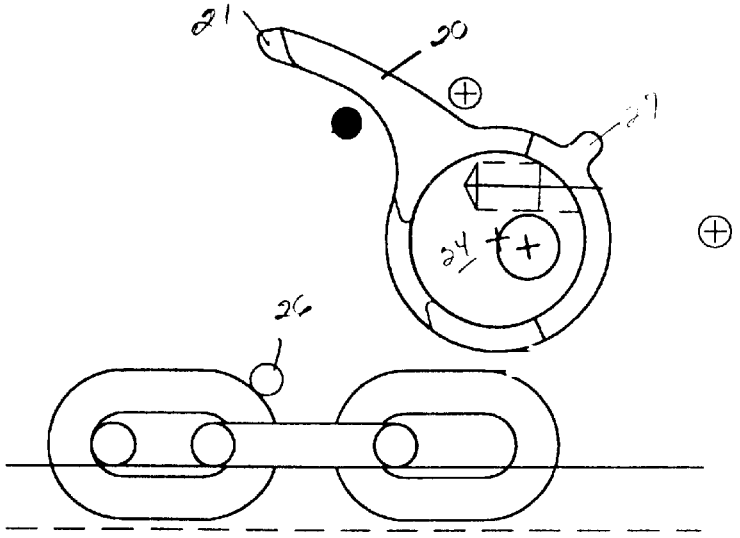
FIG. 6 is another view of the pawl of FIG. 5 in the unlocked position.

Reference is now had to FIGS. 5 and 6, wherein a schematic is shown with the pawl 20 in locked position in FIG. 5 and in unlocked position in FIG. 6. As shown, the pawl 20 is an integral portion of a substantially cylindrical member 40.

As stated hereinabove, cylindrical hollow member 40 is rotatably mounted to cylinder 44 eccentrically mounted by pin 25. The position of the pawl has been adjusted so that it rotates into an open link of the anchor and then cylinder 24 is rotated by handle 31 (not shown in this view) to move the pawl forward to abut the next link and hold the chain taut. It is to be noticed that pawl 20 has a nose 21 to fit into a chain link and that base 18 is configured such that the alternate links are horizontal to receive nose 21 of pawl 20.

As seen in FIG. 6, the stop pin 44 has been moved to bores 28 to keep the pawl 20 out of engagement with the chain.

Figure 7:
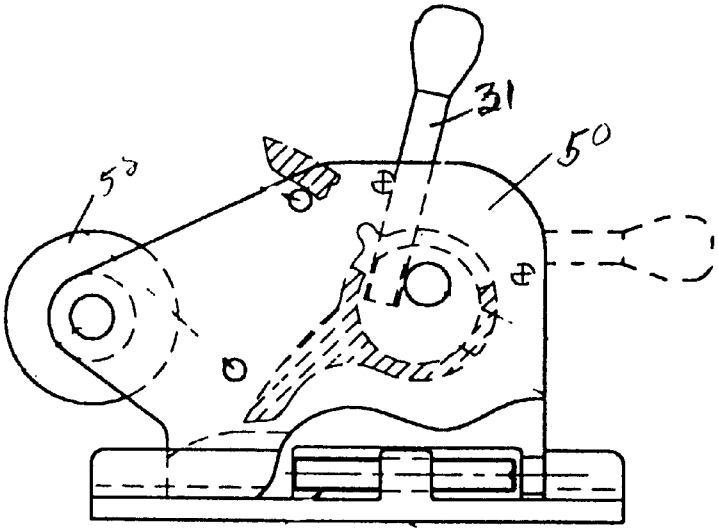
FIG. 7 is a side elevational view of an alternate embodiment of the present invention, including a guide roller.
Figure 8:
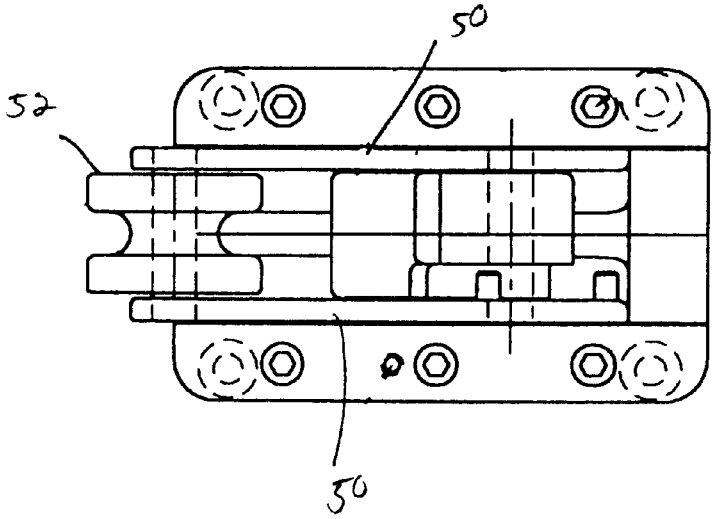
FIG. 8 is a top plan view of the device shown in FIG. 7.

FIGS. 7 and 8 disclose another embodiment of the chain snubber stopper wherein the side plates 12 (denoted 50 in these views) have been extended forwardly to support a guide roller 52 to guide the chain.

Figure 9:
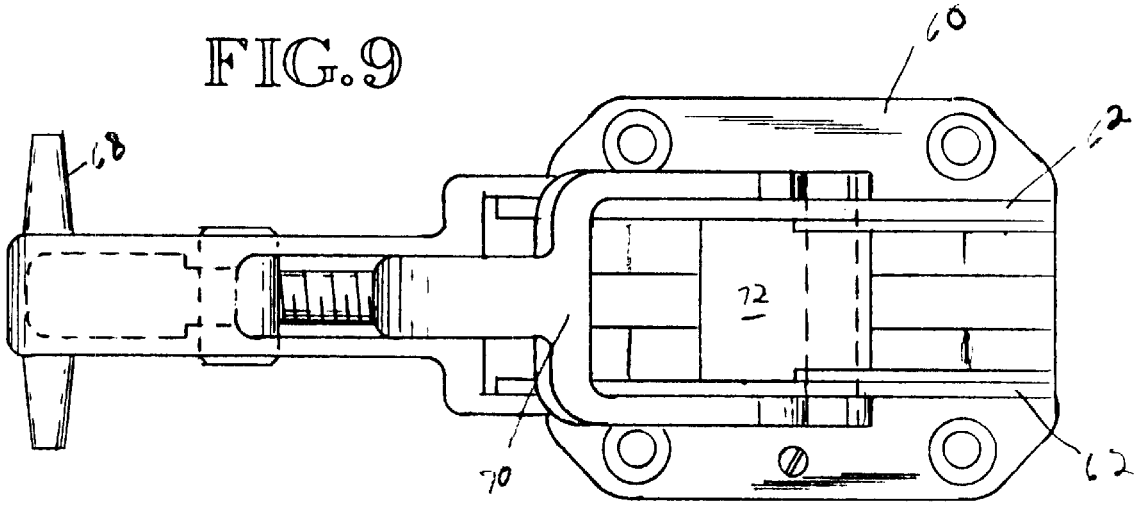
FIG. 9 is a top plan view of a second alternative to the snubber stopper of FIG. 1.
Figure 10:
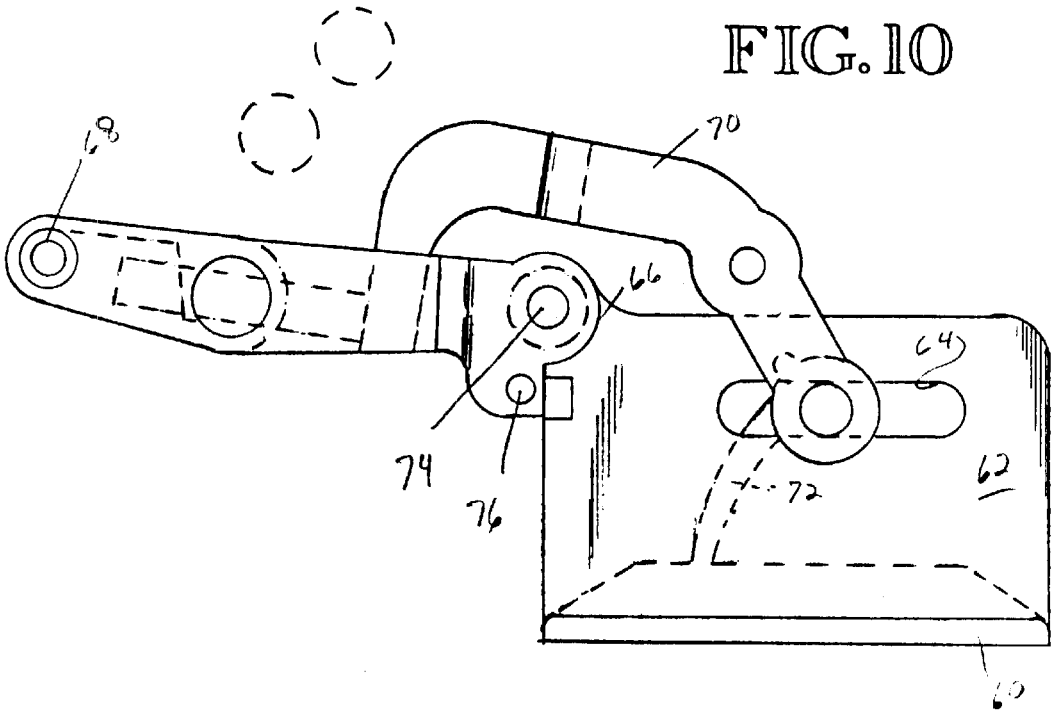
FIG. 10 is a side elevational view of the snubber stopper of FIG. 9.

The embodiment of the snubber stop mechanism shown in FIGS. 9 and 10 utilize a base member 60 to which are secured a pair of parallel opposed uprights 62, including horizontal slots 64 (see FIG. 10) and upwardly and forwardly projecting pair of ears 66. A handle 68 is threadingly engaged to a yoke element 70 which terminates at its outer end in a rigid pawl 72 which is movable from its locked to its unlocked position by arcuate movement of handle 68 about pivot 74. The adjustment in the relative position of the pawl 72 and a chain passing thereunder requires the removal of the release pin 74 as well as the release pin 76, and then to adjust the pawl relative to the chain. The handle 68 rotated about its axis such that it causes the yoke to move linearly therealong, moving the pawl to assure that it is in a position to hold the chain under tension.

Thus, as can be seen, the present invention provides an inexpensive, straightforward mechanism for serving as the stop for a chain such as an anchor or the like, as well as providing a means whereby there is a linear adjustment, assuring that the chain when the anchor is stowed, is held in a taut condition preventing undue rattling.

Although a preferred embodiment of the invention has been disclosed here for purposes of illustration, it should be understood that various changes, modifications and substitutions may be incorporated without departing from the spirit of the invention, which is defined by the claims which follow.

What is claimed is:

1. A device securing a chain, comprising:

a base member fixedly secured to a relatively fixed object; and an upper element including a pawl selectively engageable with a chain passing between it and the base member, wherein the device includes means adjustable along the length of the chain to assure positive engagement therewith and means generating movement of the pawl engaged with the chain, placing the chain in a taut condition.

2. A snubber stop assembly for use in securing a chain comprising:

a base assembly for securement to a relatively fixed element defining a path of travel for the chain; and a stop assembly adjustable relative to the base assembly, including a pawl selectively engageable with a chain, wherein the pawl is adjustable relative to the base assembly along the path of travel of the chain, whereby when engaged, the pawl holds the chain in a taut condition.

3. A snubber stop assembly for use in securing a chain comprising:

a base assembly for securement to a relatively fixed element defining a path of travel for the chain; and a stop assembly, including a pawl selectively engageable with a chain, said pawl including a handle secured to an over center locking device controlling the position of the pawl, and further, wherein the pawl is adjustable relative to the base assembly along the path of travel of the chain, whereby when engaged, the pawl holds the chain in a taut condition.

4. A device for securing a chain, comprising:

a base member secured to a relatively fixed object; and an upper element, including a pawl, selectively engageable with a chain, wherein the pawl is adjustable along the length of the chain to enable it to positively engage the chain to prevent movement of the chain and further movable along the length of the chain to assure a taut condition wherein the movement is generated by a cam member to which the pawl is mounted.

* * * * *

UNITED STATES PATENT AND TRADEMARK OFFICE

CERTIFICATE OF CORRECTION

PATENT NO. : 6,425,339 B1 
DATED : September 17, 2002
INVENTOR(S) : Morrissey et al.

It is certified that error appears in the above-identified patent and that said Letters Patent is hereby corrected as shown below:

Column 10,
Line 5, delete "sold" and substitute -- solid -- therefor

Signed and Sealed this

Thirtieth Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,425,339 B1 
DATED : September 17, 2002
INVENTOR(S) : Donn B. Furlong et al.

It is certified that error appears in the above-identified patent and that said Letters Patent is hereby corrected as shown below:

This certificate supersedes Certificate of Correction issued September 30, 2003, the number was erroneously mentioned and should be vacated since no Certificate of Correction was granted Signed and Sealed this Thirtieth Day of March, 2004

JON W. DUDAS
*Acting Director of the United States Patent and Trademark Office*